US005217267A

United States Patent [19]

Yagi

[11] Patent Number: 5,217,267

[45] Date of Patent: Jun. 8, 1993

[54] TELESCOPIC SUPPORT ARM

[75] Inventor: Katumi Yagi, Osaka, Japan

[73] Assignee: Kabushikigaisha Yagi, Osaka, Japan

[21] Appl. No.: 833,773

[22] Filed: Feb. 11, 1992

[51] Int. Cl.[5] ..... E05C 17/06

[52] U.S. Cl. ..... 292/338; 217/60 F; 292/278; 292/267; 292/DIG. 4

[58] Field of Search ..... 217/60 R, 60 F; 292/338, 262, 267, 278, DIG. 4; 16/82

[56] References Cited

U.S. PATENT DOCUMENTS

| | | | |
|---|---|---|---|
| 2,229,513 | 1/1941 | Lustig | 217/60 F |
| 2,288,925 | 7/1942 | Simpson | 217/60 F |
| 2,551,010 | 5/1951 | Kammeraad | 292/267 |
| 2,916,176 | 12/1959 | Widmer | 217/60 F |
| 2,994,451 | 8/1961 | Hoag et al. | 217/60 F |
| 2,996,210 | 8/1961 | Thomas | 217/60 F |
| 3,000,044 | 9/1961 | Allen et al. | 217/60 F |
| 3,019,934 | 2/1962 | Bogater et al. | 217/60 F |
| 3,117,689 | 1/1964 | Dedic, Sr. | 217/60 R |
| 4,042,266 | 8/1977 | Anderberg et al. | 292/267 |

FOREIGN PATENT DOCUMENTS

| | | | |
|---|---|---|---|
| 810119 | 5/1948 | Fed. Rep. of Germany | 217/60 F |
| 2826002 | 12/1979 | Fed. Rep. of Germany | 292/278 |
| 427920 | 12/1947 | Italy | 292/278 |
| 1416535 | 12/1975 | United Kingdom | 292/267 |

*Primary Examiner*—Eric K. Nicholson
*Attorney, Agent, or Firm*—Koda and Androlia

[57] ABSTRACT

A telescopic support arm includes an outside arm and an inside arm which are designed to slide freely each other, the outside arm having a slot and an abutting piece inside thereof, and the inside arm having a slot and rotatable stopping piece inside thereof. The stopping piece is rotated by the engagement with the end portions of the slots and the abutting piece so as to be projected out of or sink into the slots, and by its rotation the outside arm and the inside arm are free to slide each other in both the extending and contracting directions. The stopping piece is provided with a buffer mechanism which comprises a holding piece of the stopping piece, a spring for pulling the holding piece in the contracting direction of the telescopic support arm, and a slot for slidably supporting a support shaft of the stopping piece. A rack with a tooth part is disposed in the outside arm along its longitudinal direction, while a locking piece with a pawl part is provided in the inside arm. While the support arm expands, the pawl part engages with each tooth of the tooth part one by one, so that the length of the support arm may be adjusted by arresting the pawl part at a desired position.

5 Claims, 14 Drawing Sheets

TELESCOPIC SUPPORT ARM

BACKGROUND OF THE INVENTION

1. Field of the Invention

The present invention relates to a telescopic support arm used in windows, inspection ports, doors of various devices and others.

2. Prior Art

Various telescopic support arms have been hitherto invented. For example, a support arm is designed in a telescopic structure by moving a piston rod reciprocally within a cylinder. Such a telescopic support arm is used by attaching its one end to a door and the other end to a door support frame.

In such a conventional telescopic support arm, however, when a door is opened forcefully until the telescopic support arm is fully expanded, impact then acts directly on the junction of the cylinder and the piston rod, and therefore the durability of the arm can not be sufficient, but rather poor. Or when such telescopic support arms are used at both sides of a door, if the door is attached to the support frame in a distorted state or if a gap is formed in mounting of the door on the support frame, either one or both of the telescopic support arms may not be fully expanded, and the door cannot be opened or closed smoothly.

Still more, in such a conventional telescopic support arm, the door cannot be stopped and hold at an arbitrary position, but is stopped only at the fully opened position or at a position of a preset opening width of the door. Therefore, if it is desired to stop the door at a slightly opened position or to vary the opening width of the door frequently, this type of telescopic support arm can not suffice these requirements.

SUMMARY OF THE INVENTION

It is hence a primary object of the invention to solve the problems of the conventional telescopic support arms.

In the present invention, a telescopic support arm includes an outside arm 1 and an inside arm 2 which are designed to slide freely each other, the outside arm 1 having a slot 3 and an abutting piece 8 inside thereof, and the inside arm 2 having a slot 7 and a rotatable stopping piece 4 inside thereof. The stopping piece 4 engages with the end portions of the slots 3 and 7 and the abutting piece 8 respectively and rotates so as to project out of or sink into the slots 3 and 7, and by its rotation the outside arm and the inside arm 2 are free to slide each other in both the extending and contracting directions. The stopping piece 4 is provided with a buffer mechanism 14 which comprises a holding piece 10 of the stopping piece 4, a spring 13 for pulling the holding piece 10 in the contracting direction of the telescopic support arm, and a slot 12 for slidably supporting a support shaft 11 of the stopping piece 4.

In the present invention, moreover, a rack 5 with a tooth part 5*a* is disposed in the outside arm 1 along its longitudinal direction, while a locking piece 6 with a pawl part 6*a* is provided in the inside arm 2. While the support arm expands, the pawl part 6*a* engages with each tooth of the tooth part 5 one by one, so that the length of the support arm may be adjusted by arresting the pawl part 6*a* on a tooth at a desired position.

Moreover holes 17 which align and penetrate through both the outside and inside arms at a certain position may be provided.

The telescopic support arm of the invention, provided with such means as mentioned above, obtains the following actions.

In the telescopic support arm having the slots 3, 7, the abutting piece 8 and the stopping piece 4, the abutting piece 8 and the stopping piece 4 are engaged with each other, and then the stopping piece 4 is engaged with the end portion of the slot 3 in the outside arm 1, so that the support arm may be supported securely at the extended position. Risks such as unexpected closing of a door while working thereunder is avoided. Furthermore, a 180 degree rotation of the stopping piece 4 causes the once extended telescopic support arm to contract easily. If the door is opened forcefully, the stopping piece being pulled in the contracting direction by the spring 13 slides within the range of the length of the slot 12 of the buffer mechanism 14, and therefore direct damage on the abutting piece 8 or the stopping piece 4 is not induced, so that a durable support arm may be provided.

In the telescopic support arm having the rack 5 and the locking piece 6, when the telescopic support arm expands, the pawl part 6*a* of the locking piece 6 moves intermittently in small strokes on the tooth part 5*a* of the rack 5. In this expanding state, to the contrary, when pushing force in the contracting direction is applied on the support arm, the pawl part 6*a* of the locking piece 6 engages with a certain tooth of the tooth part 5*a* of the rack 5 and is arrested there, so that the movement in the contracting direction is deterred. Since the pawl part 6*a* moves with engaging with each tooth of the tooth part 5*a*, it is possible to provide a telescopic support arm capable of being set at a desired length.

DESCRIPTION OF THE PREFERRED EMBODIMENTS

The constitution of a telescopic support arm relating to the invention is described below while referring to an embodiment in conjunction with the accompanying drawings.

Figure 1:
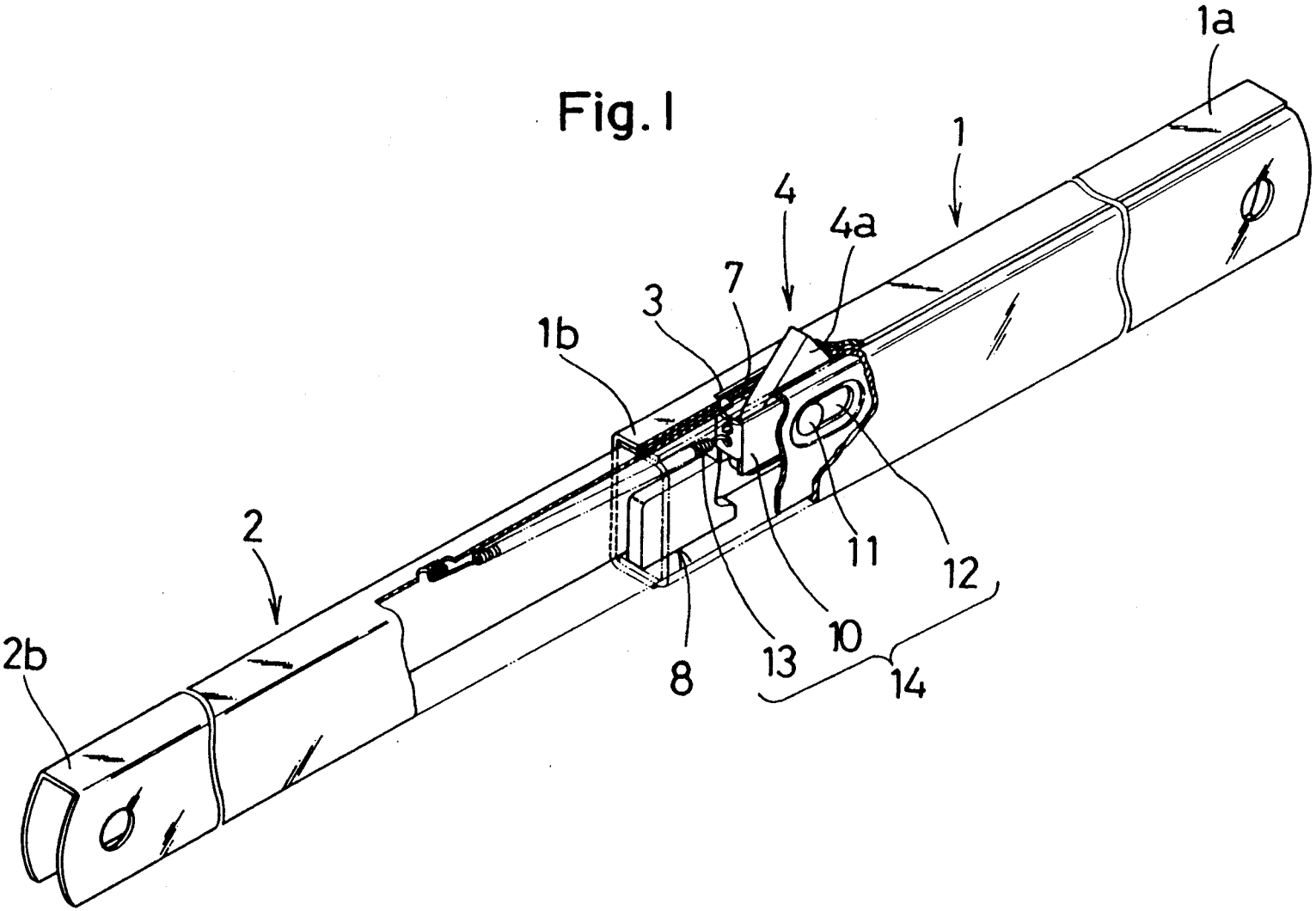
FIG. 1 is a partially cutaway perspective view of a telescopic support arm of the invention.

As shown in FIG. 1 which is a perspective view of the telescopic support arm of the invention, an outside arm 1 and an inside arm 2 are free to slide. As specifically described below, in this diagram, the telescopic support arm is extended, and a stopping piece 4 of the inside arm 2 is stopped at the front end side end portion of a slot 3 of the outside arm 1.

Figure 4:
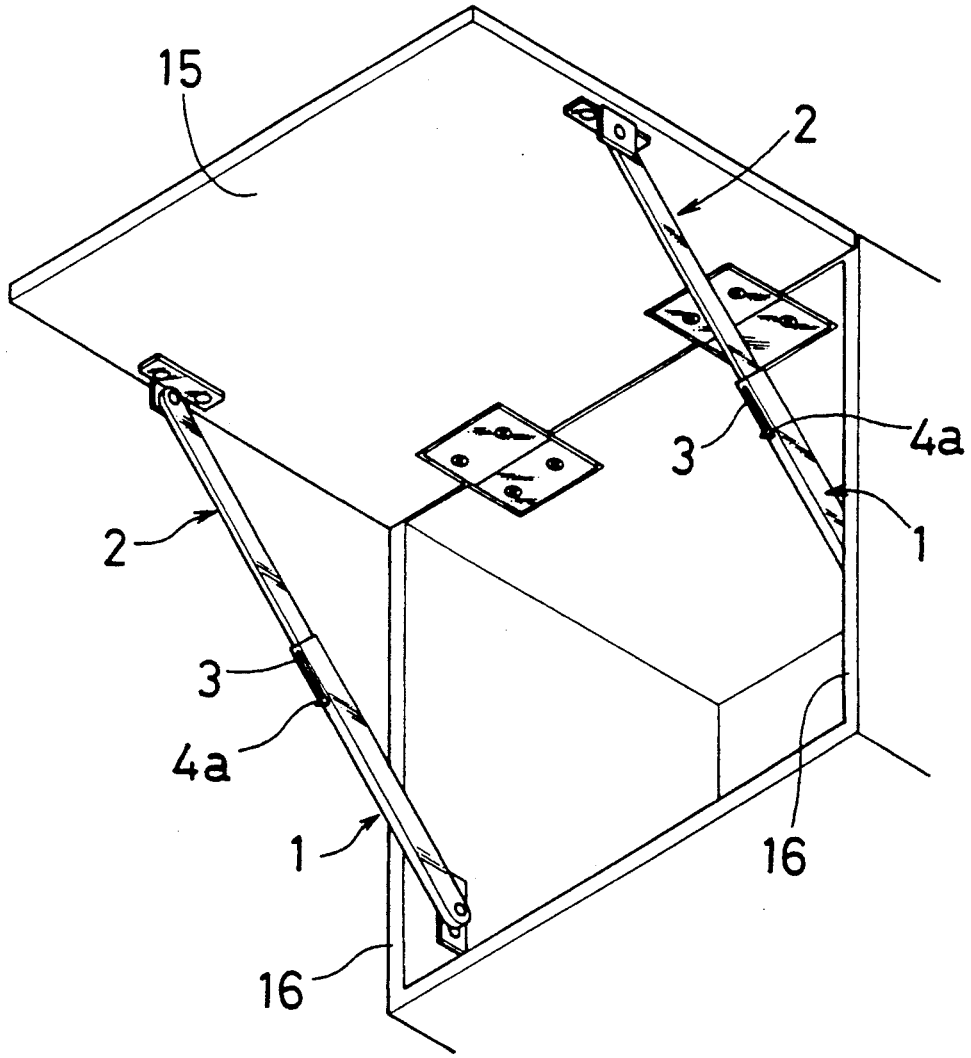
FIG. 4 is a perspective view showing a state of use in mounting the telescopic support arm of the invention.

In the specification herein, the right side in each drawing except FIG. 4 is referred to as the front end side, and the left side is referred to as the rear end side.

Figure 2:
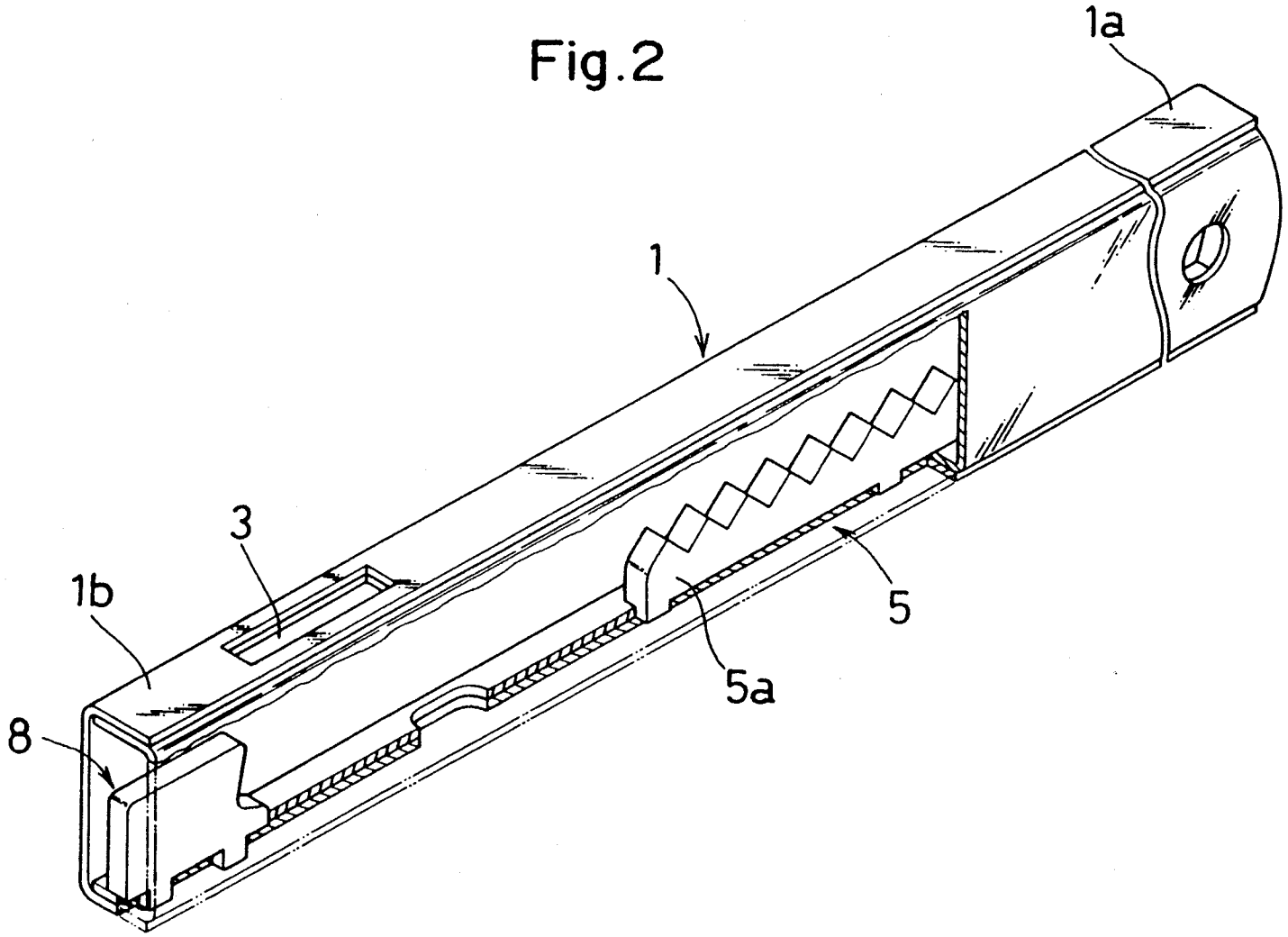
FIG. 2 is a partially cutaway perspective view of an outside arm of the invention.

As shown in FIG. 2, the outside arm 1 is formed in a quadrangular tube by joining face to face two metal plates folded in an approximately pi-section, and a rack 5 is disposed inside along the longitudinal direction. A slot 3 is disposed at the rear end side 1*b* of the outside arm, and an abutting piece 8 is provided inside this rear end side 1*b*.

Figure 3:
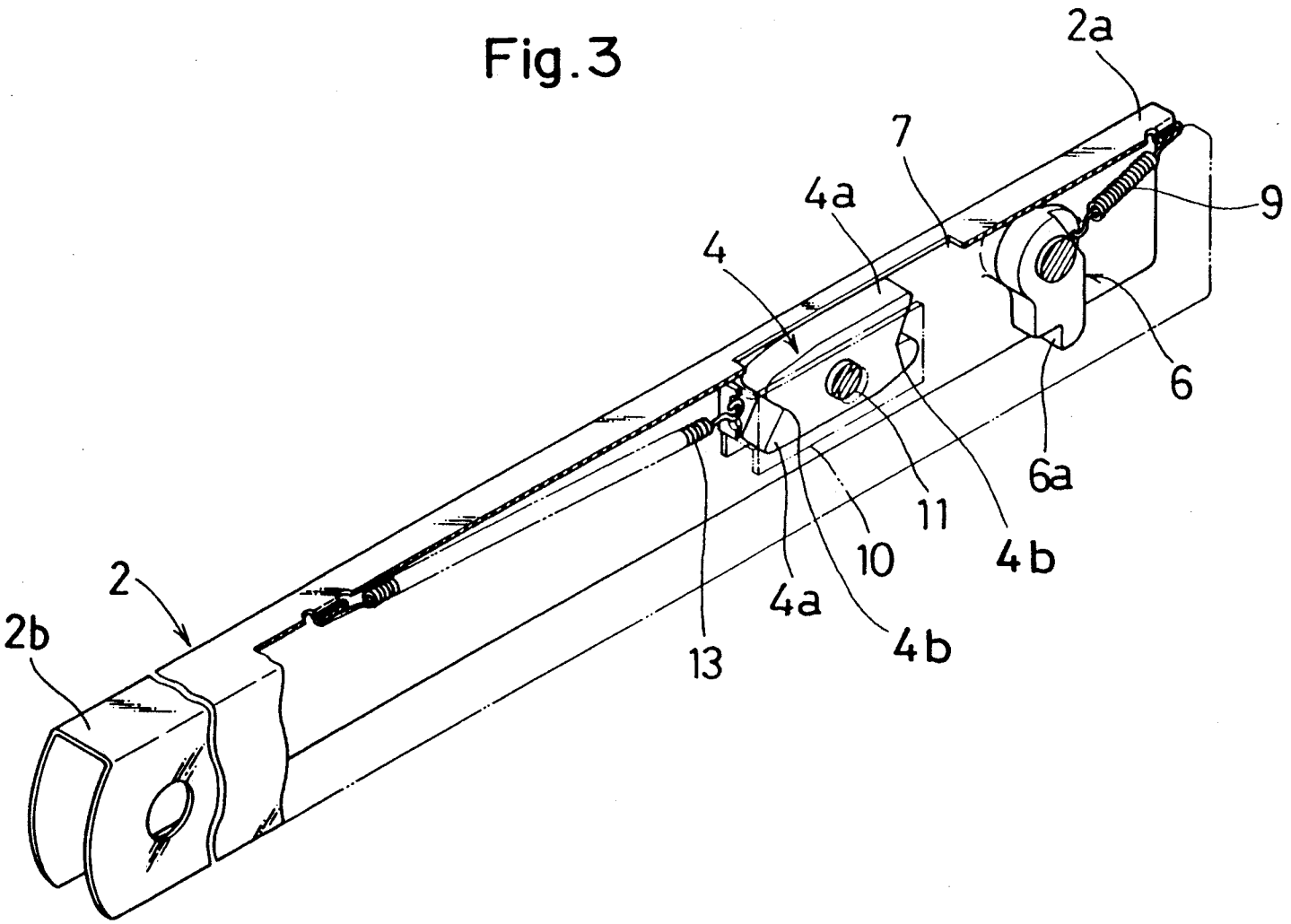
FIG. 3 is a partially cutaway perspective view of an inside arm of the invention.

The inside arm 2 is made of a metal plate folded in an approximately pi-section as shown in FIG. 3. At the front end side 2*a* of this inside arm 2, there is a locking piece 6 having a pawl part 6*a* to engage with the tooth part 5*a* of the rack 5 of the outside arm 1. This locking piece 6 is rotatably mounted on the inside arm 2 as shown in FIG. 3, and is linked with a spring 9 disposed at the front end side 2*a* of the inside arm 2. At the front end side 2*a* of the inside arm 2, a slot 7 and a rotatable stopping piece 4 is disposed, and the stopping piece 4 is designed to project out of the slots 3 and 7 in contact with the abutting piece 8 of the outside arm 1. The stopping piece 4 includes a stopping part 4*a* designed to project out to the slots 3 and 7, and a stopping part 4*b* configured as shown in the drawings and designed to securely engage with and stop at the end part of the slot 3. This stopping piece 4 is provided with a buffer mechanism 14 comprising a holding piece 10 of the stopping piece 4, a spring 13 for pulling this holding piece 10 in the contracting direction of the telescopic support arm, and a slot 12 for slidably supporting a support shaft 11 of the stopping piece 4.

The state of action of the telescopic support arm relating to thus composed invention is described below.

A telescopic support arm of the invention is used for example as shown in FIG. 4. One end of a telescopic support arm is attached to one side of the door and the other end of the support arm is attached to the same side of a support frame 16 of the door 15. And another support arm is likewise attached to the other side of the door and its support frame. In this diagram, in the fully opened position of the door 15, the stopping piece 4 of the inside arm is stopped by the front-end-side end portion of the slot 3 of the outside arm 1.

Figure 5:
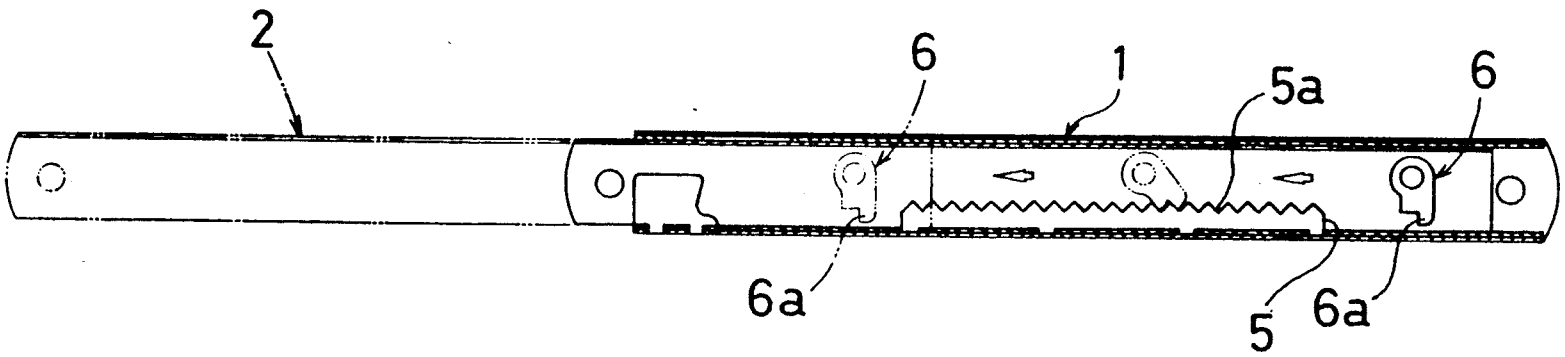
FIG. 5 is an explanatory diagram showing a state of a tooth part of a rack and a pawl part of a locking piece while the telescopic support arm extends.

When the telescopic support arm extends from the contracted state, as indicated by virtual line in FIG. 5, the pawl part 6*a* of the locking piece 6 moves intermittently at small strokes along the tooth part 5*a* of the rack 5. That is, the pawl part 6*a* of the locking piece 6 moves further while sequentially engaging with each tooth of the tooth part 5*a* of the rack 5. At this time, to the contrary, when force in the contracting direction is applied to the telescopic support arm, the pawl part 6*a* of the locking piece 6 engages with the tooth part 5*a* of the rack 5 and is arrested, thereby no longer contracting. By thus adjusting the engaging position, the telescopic support arm is adjusted to a desired length, and therefore the door 15 may be stopped at a specified position.

Figure 6:
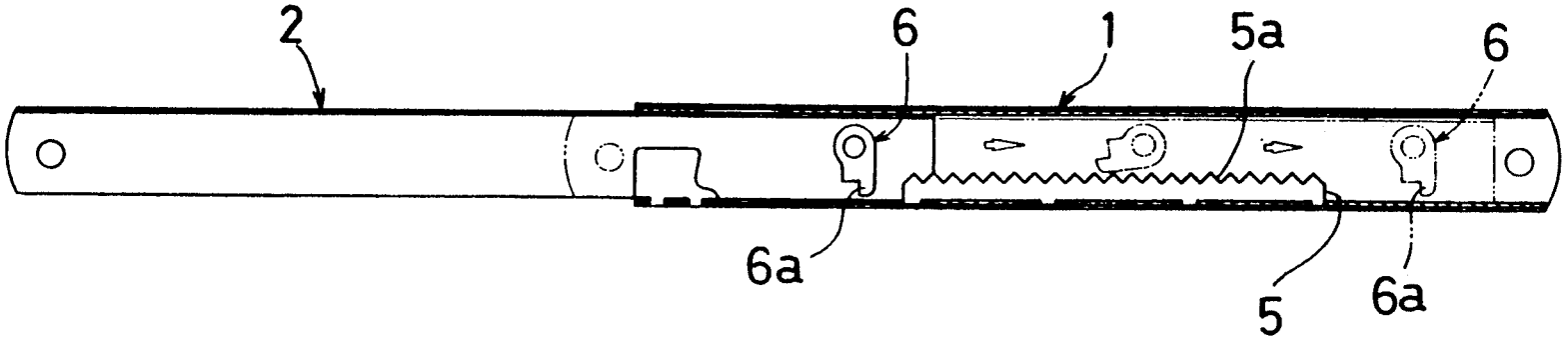
FIG. 6 is an explanatory diagram showing a state of the tooth part of the rack and the pawl part of the locking piece while the telescopic support arm contracts.

When the telescopic support arm extends, as shown by solid line in FIG. 6, the pawl part 6*a* of the locking piece 6 rides over the tooth part 5*a* of the rack 5, and the engagement between the pawl part 6*a* and the tooth part 5*a* is cleared, and the locking piece 6 is returned to the position approximately vertical to the longitudinal direction by the spring 9.

Since the locking piece 6 returns to the position approximately vertical to the longitudinal direction after riding over the rack 5, the pawl part 6*a* and the tooth part 5*a* are securely engaged with each other in the extending direction, and are securely disengaged in the contracting direction.

Figure 7:
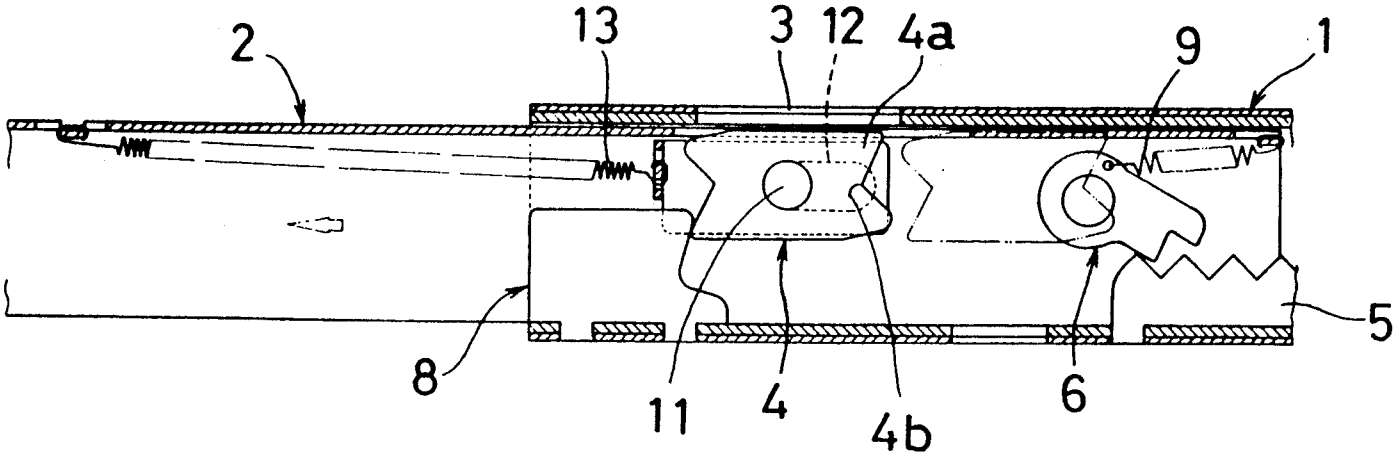
FIG. 7 is an explanatory diagram showing a state where a stopping piece of the inside arm abuts against an abutting piece of the outside arm (a state just before the stopping piece slightly projects from the slot of the arm)
Figure 8:
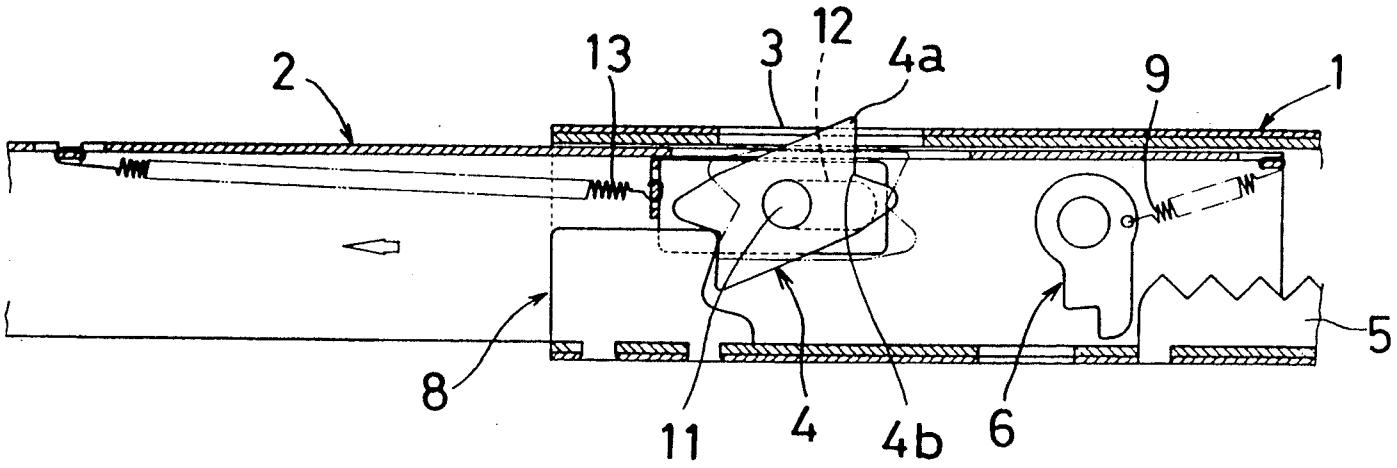
FIG. 8 is an explanatory diagram showing a state where the stopping piece of the inside arm slightly projects from the slot of the outside arm.

FIG. 7 shows the state in which the telescopic support arm is extended, and the stopping piece 4 of the inside arm 2 is abutting against the abutting piece 8 of the outside arm 1, that is, the state just before the stopping piece 4 is projecting out of the slots 3 and 7. Here, when the telescopic support arm is further extended, the stopping piece 4 of the inside arm 2 is rotated as being pushed by the abutting piece 8 of the outside arm 1, thereby slightly projecting out of the slot 3 (see FIG. 8).

Figure 9:
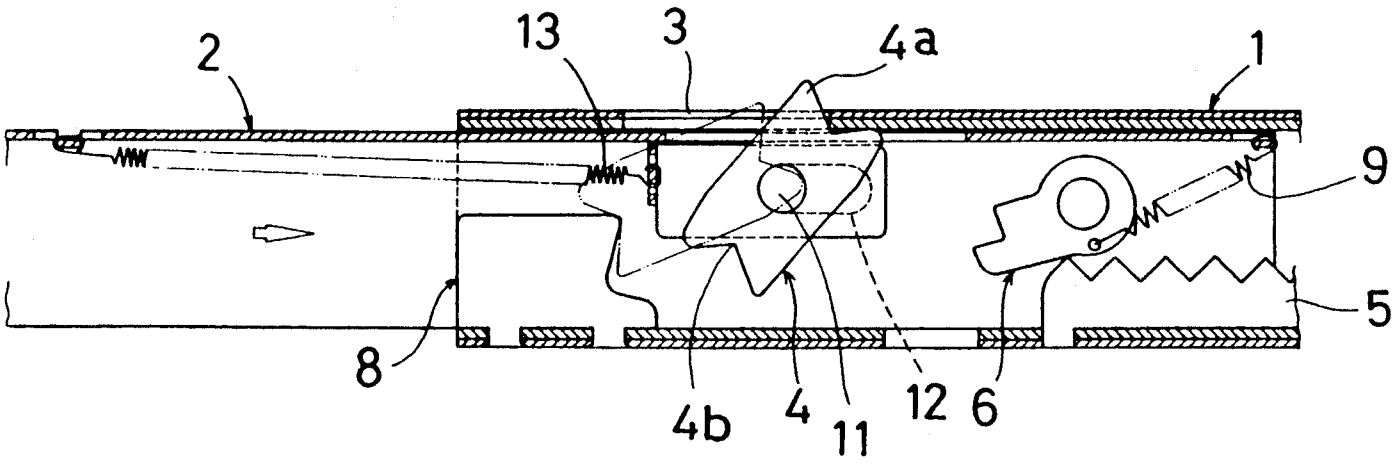
FIG. 9 is an explanatory diagram showing a state where the stopping piece of the inside arm stops in the end portion of the slot of the outside arm.

At this time, when the telescopic support arm is contracted, the stopping piece 4 moves away from the abutting piece 8, and the stopping part 4*a* of the stopping piece contacts with the front-end-side end portion of the slot 3 of the outside arm 1. When pushed further in the contrating direction, the stopping piece 4 slightly rotates, and is securely stopped in the front-end-side end portion of the slot 3 by the stopping piece 4*b* (see FIG. 9).

Figure 10:
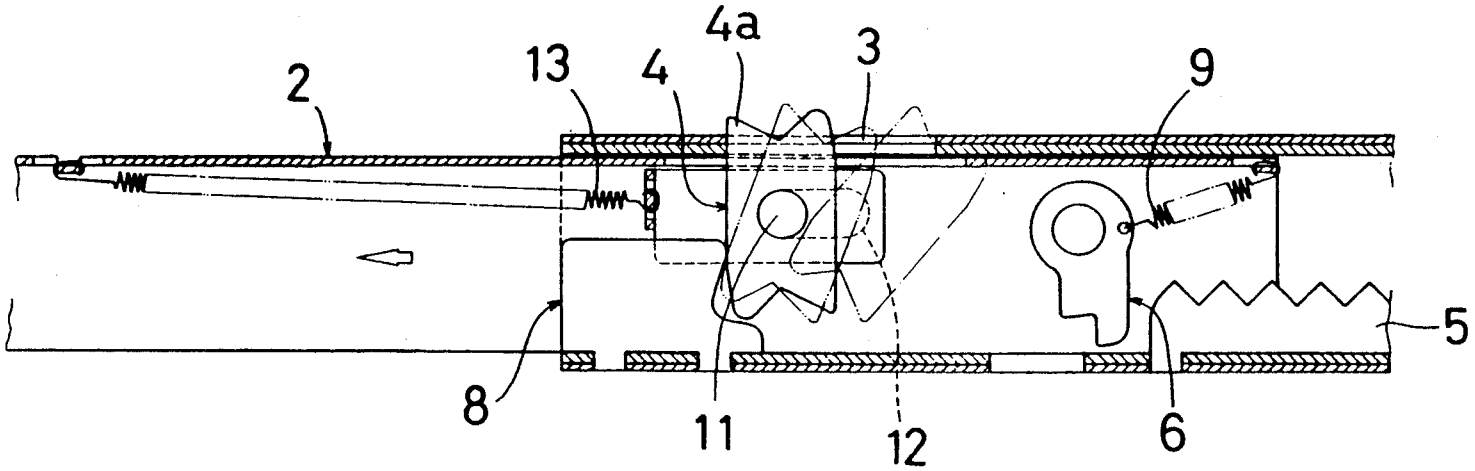
FIG. 10 is an explanatory diagram showing a state where the stopping piece rotates and disengages from the front-end-side (right) end portion of the slot of the outside arm and then engages with the rear-end-side (left) end portion.
Figure 11:
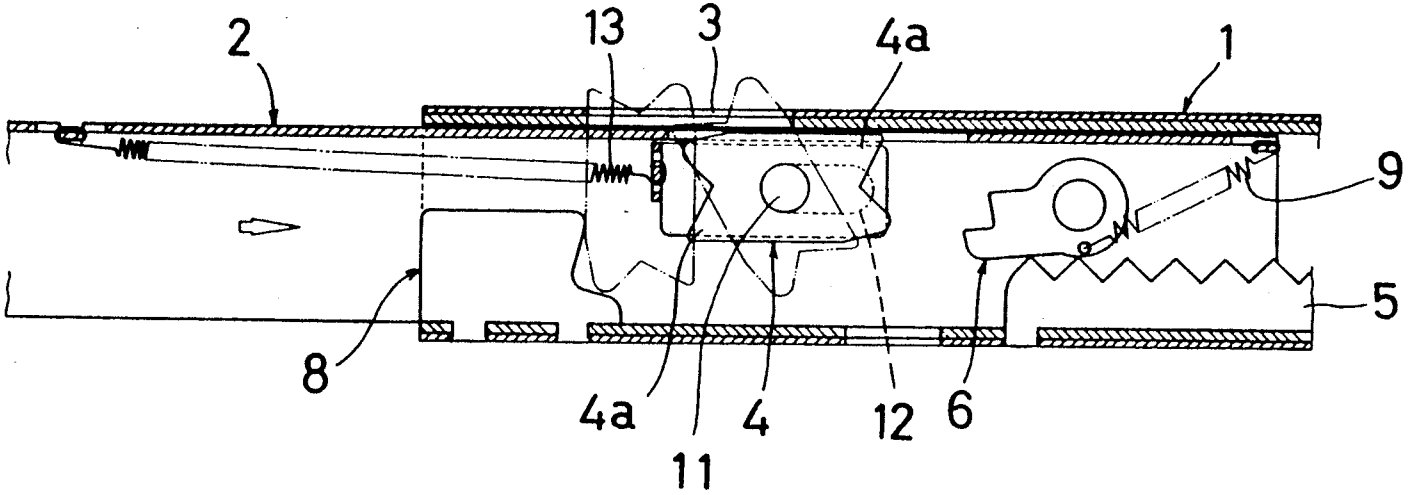
FIG. 11 is an explanatory diagram showing a state where after the state in FIG. 10 the stopping piece of the inside arm rotates further to sink again into the outside and inside arms while the telescopic support arm contracts.

From this state, when the telescopic support arm is extended, as shown in FIG. 10, the engagement of the stopping piece 4 of the inside arm 2 and the front-end-side end portion of the slot 3 of the outside arm 1 is cleared, and the stopping piece 4 abuts against the abutting piece 8 again. At this time, since the stopping piece has turned further, the abutting piece 8 contacts with the side free from the stopping part 4*b* of the stopping part 4. When extended furthermore, the abutting piece 8 pushes to rotate the side free from the stopping part 4*b* of the stopping piece 4, and the stopping piece 4 stops with the side free from the stopping part 4*b* abutting against the rear-end-side end portion of the slot 3 of the outside arm. Here, when the telescopic support arm is contracted, the other side free from the stopping part 4*b* of the stopping piece 4 abuts against the front-end-side end portion of the slot 3. However, since this side has no stopping part 4*b*, the stopping piece 4 rotates and sinks into the inside arm. At this time, the stopping piece 4 is rotated by 180 degrees from the original position. This state is clearly illustrated in FIG. 11.

Figure 12:
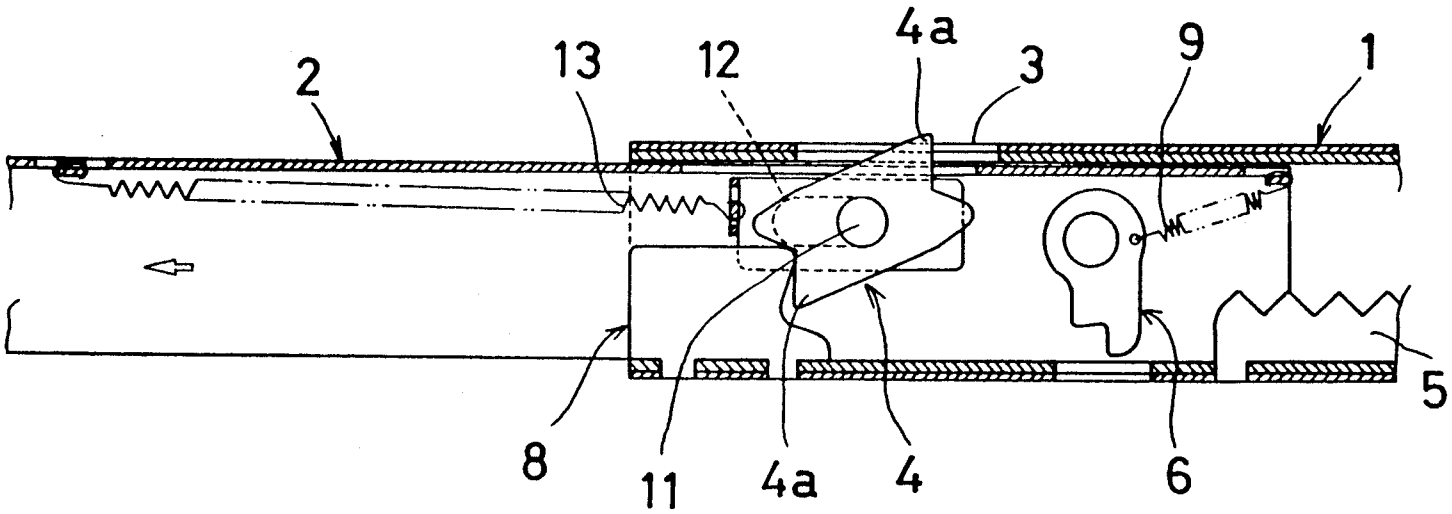
FIG. 12 is an explanatory diagram showing a state where in the state in FIG. 8 the telescopic support arm further extends under a buffer action when further force is added in the extending direction.
Figure 13:
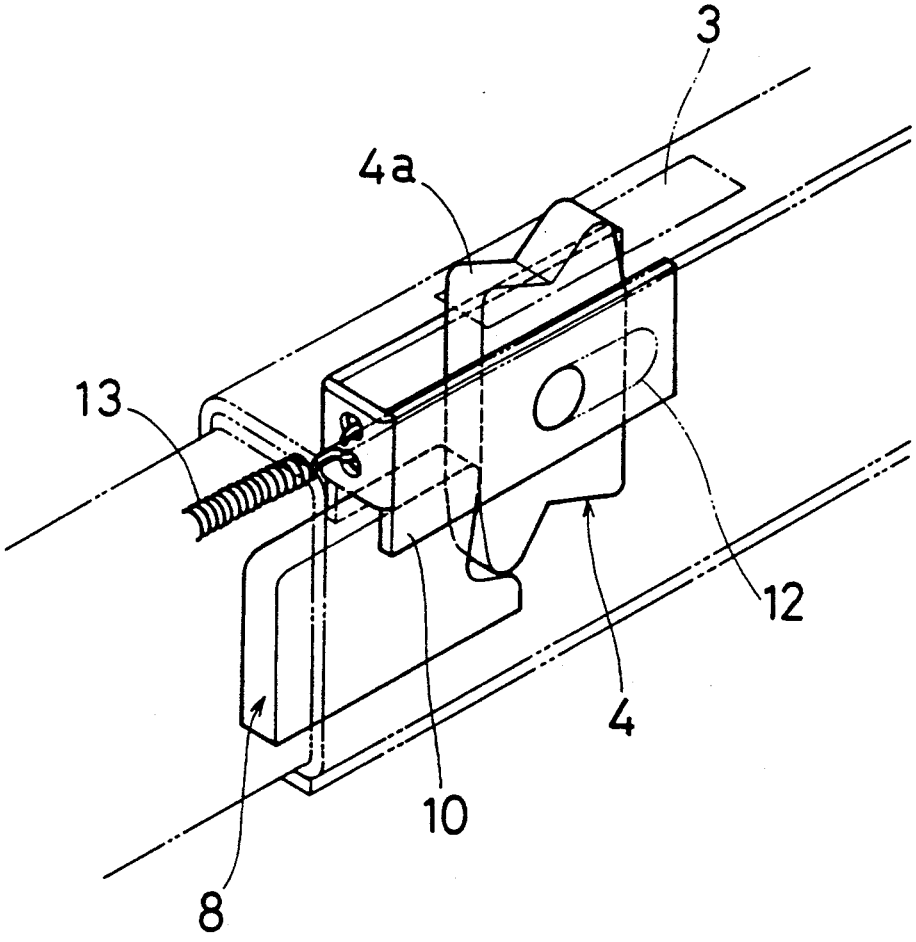
FIG. 13 is a perspective view showing a configuration of the stopping piece, the abutting piece, and the slot of the outside arm in the state in FIG. 10.

As clear from the drawings above, the shaft 11 of the stopping piece 4 is disposed slidably in the slot 12, and a spring 13 is disposed in the manner of connecting the holding piece 10 and the inside arm 2. Therefore, if the door 15 is opened forcefully, or otherwise further force is applied in the extending direction to the telescopic support arm which is already in fully extended state in ordinary condition, the support arm is extended more by the range of the length of the slot 12 (see FIG. 12), through the sliding of the shaft 11 in the slot 12 and is returned to the ordinary maximum length by the function of the spring 13 pulling back the holding piece and the inside arm 2. Then the buffer action is obtained. In the state shown in FIG. 10, too, the telescopic support arm can be extended more than the ordinary maximum length by the length of the slot 12, by means of the buffer mechanism 14. Therefore, the members of the support arm does not suffer direct damage, and furthermore, even if the door 15 is mounted distortedly on the support frame 16 or there is a gap in mounting of the door 15 on the support frame 16, such a distortion or a gap on the telescopic support arms at both sides of the door may be adjusted by the buffer mechanism 14.

Figure 14:
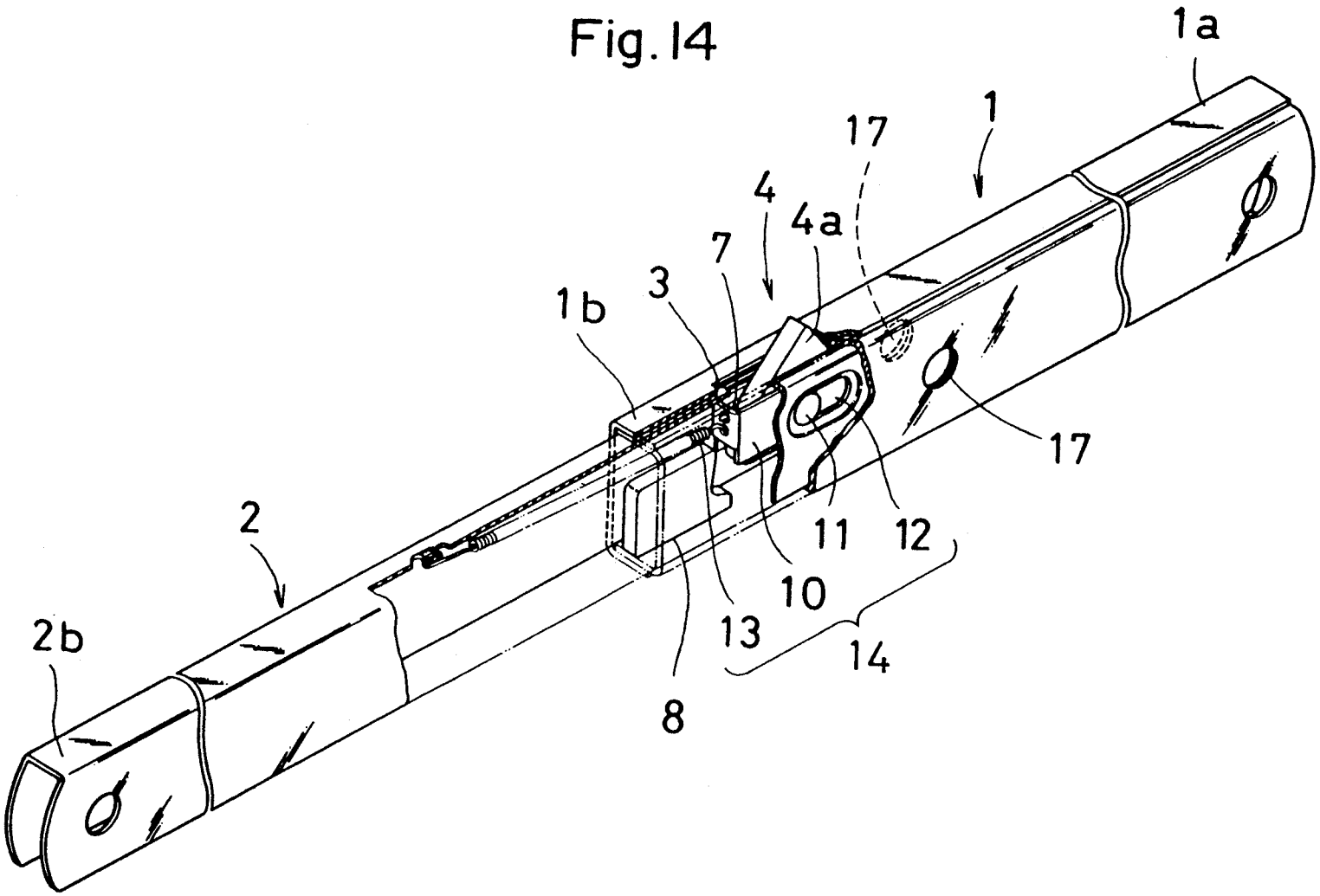
FIG. 14 is a perspective view of the outside and inside arms which have holes designed to align and form a penetrating hole through both the arms.

In FIG. 14, holes 17 are provided in both the outside arm 1 and the inside arm 2. The holes 17 are designed to align at a certain position to form a penetration hole through both the arms 1, 2. By passing iron bars or the like into and through the holes 17 of the outside and inside arms 1, 2, the risk of sudden contraction of the telescopic support arm may be further reduced. In this embodiment, the holes 17 are disposed at one position of the ordinary maximum length of the telescopic support arm, but it is not limitative, and it may be located at any position or at plural positions. It is also possible that the door can be locked by inserting a locking key or the like through the holes 17.

The telescopic support arm of the invention possesses the above constitution and hence brings about the following benefits.

By the constitution comprising the slots, the abutting piece and the stopping piece, the support arm can be securely maintained at a position of an extended length, and by rotation of the stopping piece, the telescopic support arm once extended may be easily contracted. Furthermore, by the constitution of the buffer mechanism, if the door is opened forcefully, or if the telescopic support arms are mounted distortedly on both sides of the door, direct damage is not induced on the abutting piece or the stopping piece, so that the durability is improved.

The engagement of the tooth part of the rack and the pawl part of the locking piece enables the telescopic support arm to be set to a desired length. Therefore, the telescopic support arm of the present invention may be used so much conveniently in various doors, and in a desired length.

Holes penetrating through both the inside and outside arms enhance the safety of the support arm in use and enables the support arm to be locked with a key.

What is claimed is:

1. A telescopic support arm comprising:

an outside arm (1) having a slot (3) and an abutting piece (8), an inside arm (2) having a slot (7) and a rotatable stopping piece (4) and being slidably mounted on the outside arm (1), the stopping piece (4) being rotated by engaging with the end portions of the slot (3) of the outside arm (1) and the abutting piece (8) so as to project out of and sink into the slots (3) (7) of the outside and inside arms (1) (2), the inside arm (2) being designed to slide into and out of the outside arm (1) in both the extending and contracting directions by the rotation of the stopping piece (4), and the stopping piece (4) being further provided with a buffer mechanism (14) so as to prevent damage of the abutting piece (8) and the stopping piece (4) when too much extending force is applied thereto.

2. A telescopic support arm according to claim 1, wherein the buffer mechanism (14) further includes a holding piece (10) of the stopping piece (4), a slot (12) for slidably supporting a support shaft (11) of the stopping piece (4) and a spring (13) connecting the holding piece (10) and the inside arm (2), so that when an excessive extending force is applied to the telescopic support arm it extends beyond an ordinary maximum length by the length of the slot (12) through the sliding of the support shaft (11) on the slot (12) and then contracts back to the ordinary maximum length because the spring (13) pulls back the holding piece (10) and the inside arm (2).

3. A telescopic support arm according to claim 1, wherein the outside arm 1 has a rack 5 with a tooth part 5*a* disposed along its longitudinal direction, the inside arm 2 has a locking piece 6 with a pawl part 6*a* to engage with the tooth part 5*a*, and the pawl part 6*a* moves with engaging with the tooth part 5*a* and is arrested at a desired tooth of the tooth part 5*a* so as to adjust the length of the telescopic support arm.

4. A telescopic support arm according to claim 2, wherein the outside arm 1 has a rack 5 with a tooth part 5*a* disposed along its longitudinal direction, the inside arm 2 has a locking piece 6 with a pawl part 6*a* to engage with the tooth part 5*a*, and the pawl part 6*a* moves with engaging with the tooth part 5*a* and is arrested at a desired tooth of the tooth part 5*a* so as to adjust the length of the telescopic support arm.

5. A telescopic support arm according to claim 1, wherein holes 17 are provided on both the outside arm 1 and the inside arm 2, the holes being designed to align at a certain position to form a penetration hole through both the arms 1, 2.

* * * * *